US005727456A

United States Patent [19]

Hughes

[11] Patent Number: 5,727,456

[45] Date of Patent: Mar. 17, 1998

[54] WASTE CONTAINER TOP EDGE SQUARING FIXTURE

[76] Inventor: Joel Hughes, P.O. Box 3767, Wilmington, N.C. 28406

[21] Appl. No.: 810,860

[22] Filed: Mar. 4, 1997

[51] Int. Cl.[6] ..... B30B 9/30

[52] U.S. Cl. ..... 100/219; 100/220; 220/908

[58] Field of Search ..... 100/219, 220, 100/227, 240, 245, 274–277; 220/908

[56] References Cited

U.S. PATENT DOCUMENTS 1,242,232 10/1917 Palm ..... 100/219
4,426,927 1/1984 Teague ..... 100/219
4,748,908 6/1988 Feezor et al. ..... 100/219
4,777,874 10/1988 Manning ..... 100/219
4,922,815 5/1990 Teague ..... 100/219

*Primary Examiner*—Stephen F. Gerrity

[57] ABSTRACT

A device for use with waste containers wherein the waste is packed, compressed and secured in a compact state by a series of waste compacting racks, wherein the device includes an open top waste container squaring fixture consisting of a lid rack formed from a framework of cross arms extending at right angles to each other and sized to that of the open top of the waste container. The lid rack provides a retaining member that cooperates with guide channels to maintain the top peripheral edge of the container in proper configuration to receive and support a container's top closing lid.

5 Claims, 2 Drawing Sheets

2/2

WASTE CONTAINER TOP EDGE SQUARING FIXTURE

FIELD OF INVENTION

The device of this invention is an improvement in containers for holding compressed waste material such as shown and described in U.S. Pat. No. 4,922,815, dated May 8, 1990 wherein the waste container is described as a box-like open top structure.

Attached to the inner wall surfaces of the side walls of the container are horizontally spaced apart vertically extending channel members. Each member provides a guide channel which opens to the interior of the container.

Within the guide channel are vertically spaced from each other, while horizontally aligned, are a series of pivotal anti-springback retainer clips.

An anti-springback rack consists of a series of elongated bars joined together adjacent their opposite ends by connecting bars. To both ends of each of the cross bars there is an anti-springback catch.

In use, as the waste material is deposited into the container, anti-springback retainer racks are placed within the open top of the container in a manner such that the end portions of the cross bars of the racks are slideably positioned within a guide channel. As the rack is forced downward through the interior of the container the catches will engage the free ends of the anti-springback clips forcing them out of the path of the catches until the rack has engaged and compressed the waste within the container, at which time the catches will pass beneath the clips and secure the rack in a waste compressing position.

SUMMARY OF THE INVENTION

A feature of this invention is a fixture that cooperates with the guide channels positioned internally of the container to square the top peripheral edges of the container. Within the guide channels there is an internal U-shaped channel member which provides a top for the top locking fixture which will be secured to and maintain the top peripheral edge of the free edges of the container's side and end walls, in a square configuration. Thus allowing a container lid to fit properly when the full container is to be closed.

An object of this invention is to insure the proper configuration of the peripheral edge of the waste container subsequently to the loading of the container with compressed waste materials with waste material being held in a compressed condition by a waste hold-down racks so as to permit the proper support for the container's top closure lid.

DRAWINGS

The invention will be best understood by reference to the accompanying drawings in which.

Figures 5A, 5B, 6, 7:
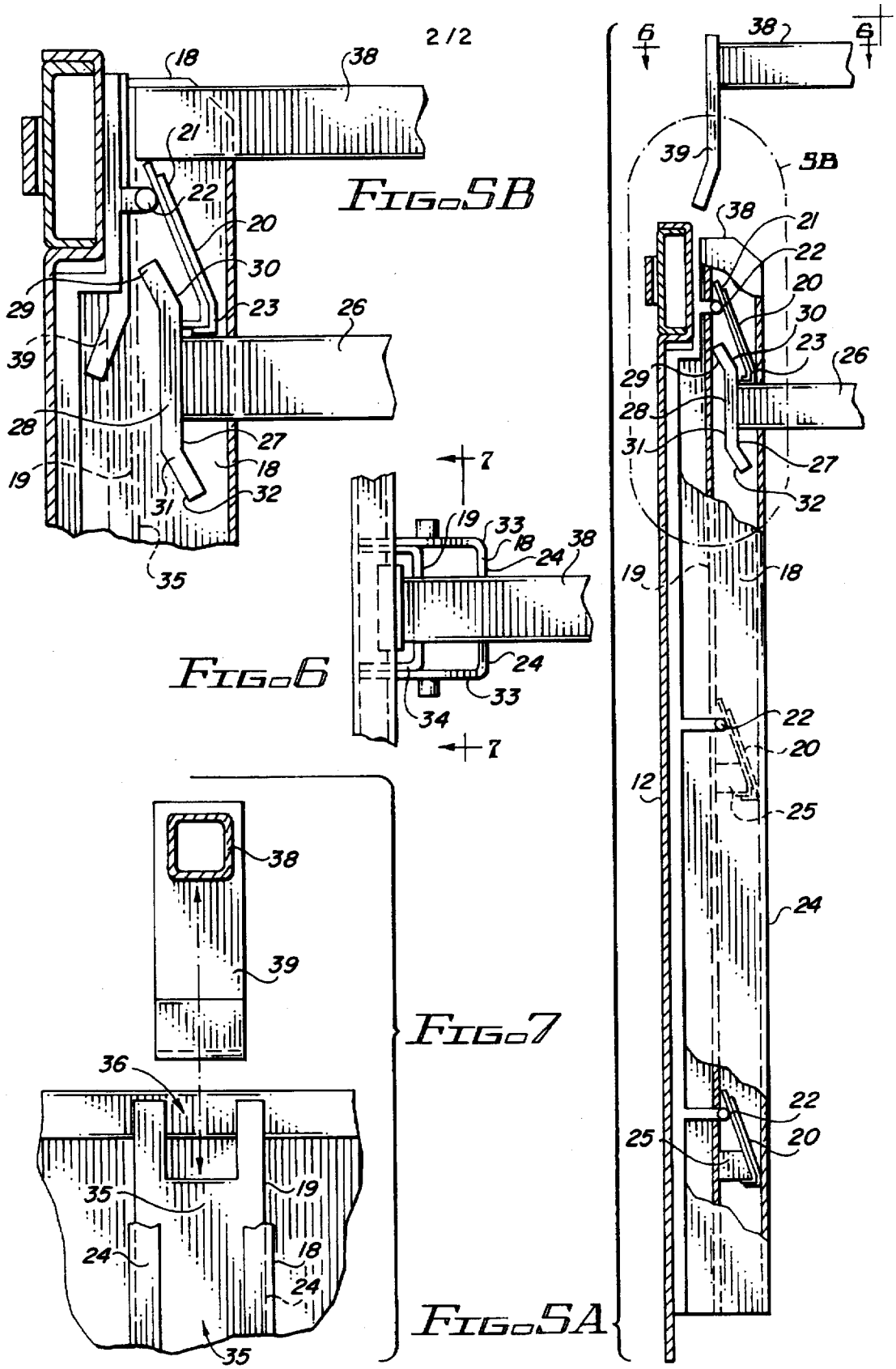

FIG. 5*a* is an enlarged fragmentary side sectional view of a portion of a container and its top locking fixture;

FIG. 5*b* is an enlarged fragmentary side sectional view of the container with the locking fixture in locked relationship;

FIG. 6 is a fragmentary top plan view of the top locking fixture in locked position relative to the side wall of the container and FIG. 7 is an enlarged exploded fragmentary view of the locking fixture and its latch.

GENERAL DESCRIPTION

Figure 1:
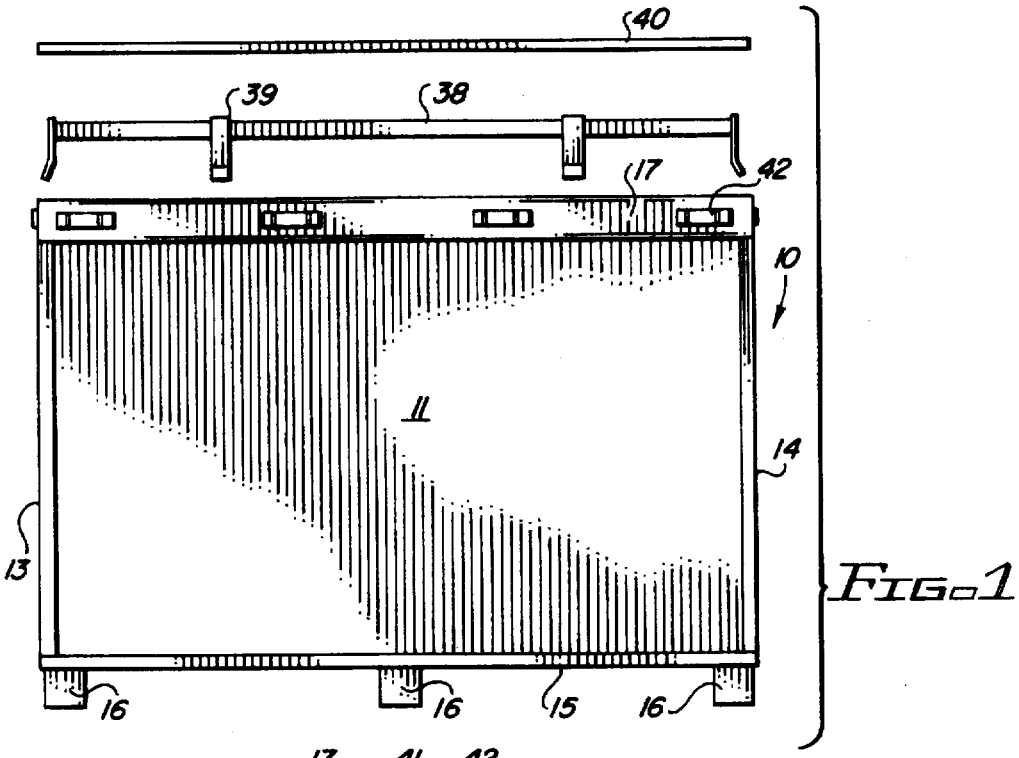
FIG. 1 is a side elevational view of the waste container utilizing this invention.

A typical waste container is indicated by the numeral 10 in FIG. 1 and discloses a box-like structure having side walls 11 and 12, end walls 13 and 14, and a bottom wall 15. The container is normally supported on a series of risers 16 which permit the handling of a fork lift or the like.

The container is provided with an exterior band 17 which details the periphery of its open top.

Attached to the inner wall surface of the side walls 11 and 12 is a series of spaced apart horizontally aligned vertically extending guide channels 18. Each of the vertical channels 18 is provided with an internal, substantial U-shaped guide channel 19 which opens through the channel 18 into the interior of the container 10.

Within the guide channels 19, and vertically spaced from each other, while being horizontally aligned, are a series of anti-springback retainer clips 20. These retainer clips 20 are constructed so as to have their uppermost ends 21 pivotally attached by pins 22, within the guide channel 19. The clip is angled in a downward direction and its free end 23 is of a size to transcend the full width of the guide channel 19. The free ends 23 are parallel to and in contact with the inwardly bent complimentary ends 24 of the guide channels 19. (See FIG. 6).

Each free end 23 of each clip 20 is backed by a neoprene rubber backing member. This backing member 25 assists in maintaining the free end 23 of the clip 20 in facial contact with the inwardly bent short end portions 24 of the guide channel 18.

To maintain the waste in a compressed condition within the container 10 there is provided anti-springback racks 26. These racks 26 consists of a frame constructed from a series of elongated bars joined together adjacent their opposite ends by connecting bars. These bars of such a length so as to have their free end portions projectable into the guide channel 18.

To each end of each of the of bars the rack 26 there is an anti-springback catch 27. These catches 27 include a rectangularly shaped end plate 28, which provides an angular end 29, which extends upwardly above the bar and provide an exposed cam face 30. The plate 28 also provides a depending end portion 31 that includes an oppositely directed cam face 32, which extends beneath the outwardly projected end of the bar.

In use and as the waste is deposited into the container 10, the anti-springback waste retainer rack 26 is placed within the open top of the container in a manner such that the end portions of the rack 26 are slideably positioned within the guide channel 18.

As the rack 26 is forced downward through the container 10 the angle cam face 32 of the catch 27 will engage the free end 23 of the anti-springback clip 20 forcing it out of the path of the catch 27, against the normal expansion force of its respective rubber backing 25 until the rack 26 has engaged and compressed the waste within the container 10. In this position the raised portion of each of the catches 27 will engage behind the free end 23 of the clip 20 and be secured against upward movement.

As shown in FIG. 6, each of the locking guide channels 18 is formed from a pair of confronting L-shaped legs 33. The ends of the short portions 24 of the legs 33 are spaced apart so as to provide a guide-way there between.

Within the locking guide channel 18 is a U-shaped inner channel forming member 34, which divides the locking guide channel 18 into two open chambers extending throughout their vertical length. This arrangement forms a substantially double chamber, vertically extending tubular-like post which strengthens the integrity of the container 10.

As shown in FIG. 7 the uppermost edge of the rear wall 35 of the guide channel member 19 is notched as at 36.

The top edge locking fixture is rack 37 made up of cross arms 38. Each end of the cross arms 38 provide a depending catch 39. It should be noted that the end portions of the cross arms 38 are of a size to fit into the notch 36 formed in the exposed top portion of the channel member 19. The catch 39 will be slideably projected between the side walls of the U-shaped channel member 19, (see FIG. 5*b*). The locking fixture will then extend above and parallel to the uppermost waste hold down bar 26.

The notch 36 allows the end of one of the cross arms 38 and its end catch 39 to freely inserted into one of the open chambers formed in the locking guide channel 18. The opposite end of the cross arms 38 of the rack 37 will be projected behind the top edge of a directly opposing guide channel mounted on the confronting inner wall surface of the container. In this arrangement the rack 37 together with its cross arms 38 will maintain a predetermined spaced relation between said opposing guides and their associated walls.

In the event that the confronting wall surfaces of the container 10 have bulged away from each other during the compression of the waste, suitable side forces can be applied pressing the bulged wall surfaces toward each other until the racks 37 have the ends of their cross arms 38 latched thereto, maintaining the walls in proper angular relation to each other such as for example in a squared condition.

When the top locking fixture has each of its racks 37 projected into a respective notch 36 formed in the complimentary positioned U-shaped channel member 18, they will tend to secure the top peripheral edge of the side and end walls in proper right angle relationship, thus resisting any outwardly bending or flexing of the container's top peripheral edge.

With the top peripheral edge of the container 10 held in proper angular relationship between its side and end walls a cover 40 will properly sit on the top of the container closing the same. The cover 40 will be secured to the container 10 by retainer clips 41.

Figure 2:
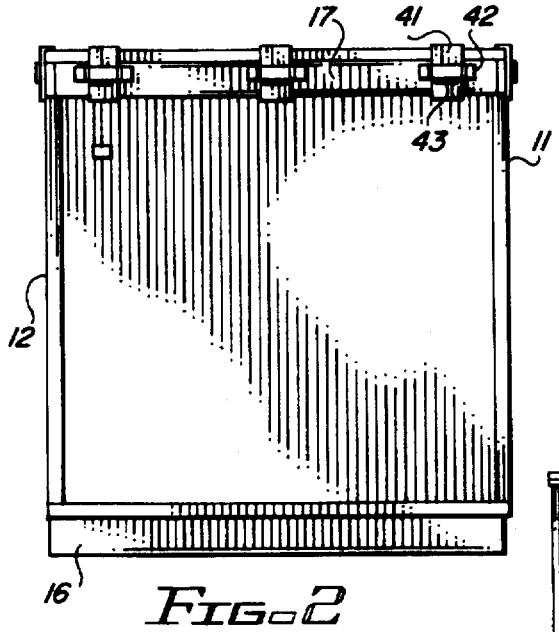
FIG. 2 is an end elevational view of the waste container.
Figure 4:
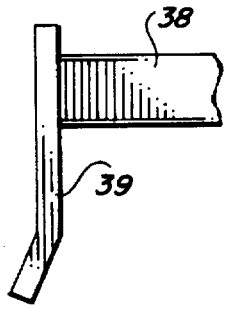
FIG. 4 is a fragmentary side elevational view taken on line 4—4 of FIG. 3.
Figure 3:
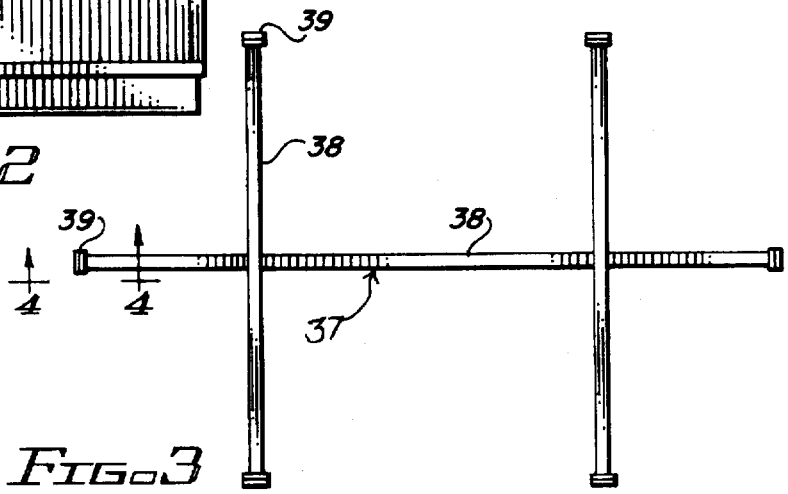
FIG. 3 is a top plan view of the top locking fixture of this invention.

As shown in FIG. 2 these clips 41 consists of an L-shaped member, the long leg of which is adapted to be projected through restraining stirrups 42 attached to the exterior of the side and end walls of the container 10. The long legs of the clips each provide a catch abutment 43 which engages the bottom edge of the stirrup 42, after the clip passes there through, such as shown in FIG. 2. This structure and its functional operation is well known in the art of compressed waste containers.

The structural integrity of the container 10 comprising the forgoing features, do not require additional wall supporting columns, making possible the optimum volume available for waste. It also reduces the number of waste retaining racks normally required.

While I have illustrated and describe the preferred form of construction for caring my invention into effect, this capable of variation and modification without departing from the spirit of the invention. I therefore, do not wish to be limited to the precise details of construction as set forth, but desire to avail myself of such variations and modifications that come within the scope of the appended claims.

Having thus described my invention what I claim as new and novel and desire to protect by Letters Patent is:

1. A compact waste container that includes a body having an open top, a bottom wall, and side and end walls providing confronting inner surfaces that has at least one waste compression frame extending between the confronting surfaces of the side and end walls and movable through a vertical component within the body against the waste compacted therein, the improvement comprising;

a) side and end wall guides comprising a pair of channel members mated so as to form a tubular post attached to confronting surfaces of the side and end walls extending from the open top to the bottom wall, with a top edge of one wall of said tubular post notched to form a receiving socket facing inwardly of said body, b) a rack of cross arms of a length to fit between said side and end wall guides with the free ends of said cross arms projected through said notches formed in the top edge of one wall of said post attached to the confronting surfaces of said side and end walls, c) a fixed catch provided at each end of each of said cross arms adapted to fit behind said socket to hold and maintain said confronting side and end wall in squared relationships, d) a lid of a size to sit upon the exposed peripheral edges of said side and end walls, and e) means for locking said lid onto said waste container body.

2. A compact waste container as defined by claim 1 wherein said pair of channel members are U-shaped in cross section.

3. A compact waste container as defined by claim 1 wherein one of said pair of channel members provides an opening facing inwardly of said container adapted to receive and guide said waste compression frame as it is moved vertically in a horizontal plane within said waste container.

4. A compact waste container as defined by claim 3 wherein said pair of channel members are U-shaped in cross section.

5. A compact waste container as defined by claim 3 wherein said notch formed in said one wall of said tubular post is in horizontal alignment with said opening formed in said one of said pair of channel members, wherein said notch is adapted to receive a free end of one of said cross arms and its fixed catch to hold and maintain said confronting side and end walls in squared relationship.

* * * * *